US010343079B1

(12) United States Patent
Semling et al.

(10) Patent No.: US 10,343,079 B1
(45) Date of Patent: Jul. 9, 2019

(54) TOY BUILDING BRICK SYSTEM

(71) Applicant: Brian's Toys Inc., Fountain City, WI (US)

(72) Inventors: Brian Semling, Fountain City, WI (US); Dustin A. Barwald, Winona, MN (US); Marc-Henry Wakim, Goodview, MN (US); Joshua M. Cherry, Winona, MN (US); Joseph Schmitt, Winona, MN (US); Akon Lee, Dongguan (CN); Jim Law, Dongguan (CN)

( * ) Notice: Subject to any disclaimer, the term of this patent is extended or adjusted under 35 U.S.C. 154(b) by 0 days.

(21) Appl. No.: 15/852,832

(22) Filed: Dec. 22, 2017

(51) Int. Cl.
*A63H 33/06* (2006.01)
*A63H 33/08* (2006.01)

(52) U.S. Cl.
CPC ..... *A63H 33/086* (2013.01); *A63H 33/062* (2013.01); *A63H 33/088* (2013.01)

(58) Field of Classification Search
CPC ... A63H 33/086; A63H 33/088; A63B 33/062
See application file for complete search history.

(56) References Cited

U.S. PATENT DOCUMENTS

| | | | | |
|---|---|---|---|---|
| 4,461,116 A * | 7/1984 | Bach | A63H 33/102 446/128 |
| 2011/0039474 A1* | 2/2011 | Bruder | A63H 33/101 446/124 |
| 2017/0203226 A1* | 7/2017 | Dorasamy | A63H 33/086 |

* cited by examiner

*Primary Examiner* — Michael D Dennis

(57) ABSTRACT

A toy building brick system includes a base brick having a cubic shape such that the base brick comprises six outer walls. The base brick has an open interior and each of the outer walls comprises a female receiver such that six female receivers are formed in the base brick. In this manner, the base brick defines an all-female brick. A plurality of inserts is provided and each of the inserts is removably engaged with one of the female receivers such that an outer surface of each of the inserts faces outwardly of the open interior.

12 Claims, 18 Drawing Sheets

TOY BUILDING BRICK SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to toy building brick devices and more particularly pertains to a new toy building brick devices for allowing a user thereof to create cubic type patterns and provide for coverings therefore.

BRIEF SUMMARY OF THE INVENTION

An embodiment of the disclosure meets the needs presented above by generally comprising a base brick having a cubic shape such that the base brick comprises six outer walls. The base brick has an open interior and each of the outer walls comprises a female receiver such that six female receivers are formed in the base brick. In this manner, the base brick defines an all-female brick. A plurality of inserts is provided and each of the inserts is removably engaged with one of the female receivers such that an outer surface of each of the inserts faces outwardly of the open interior.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
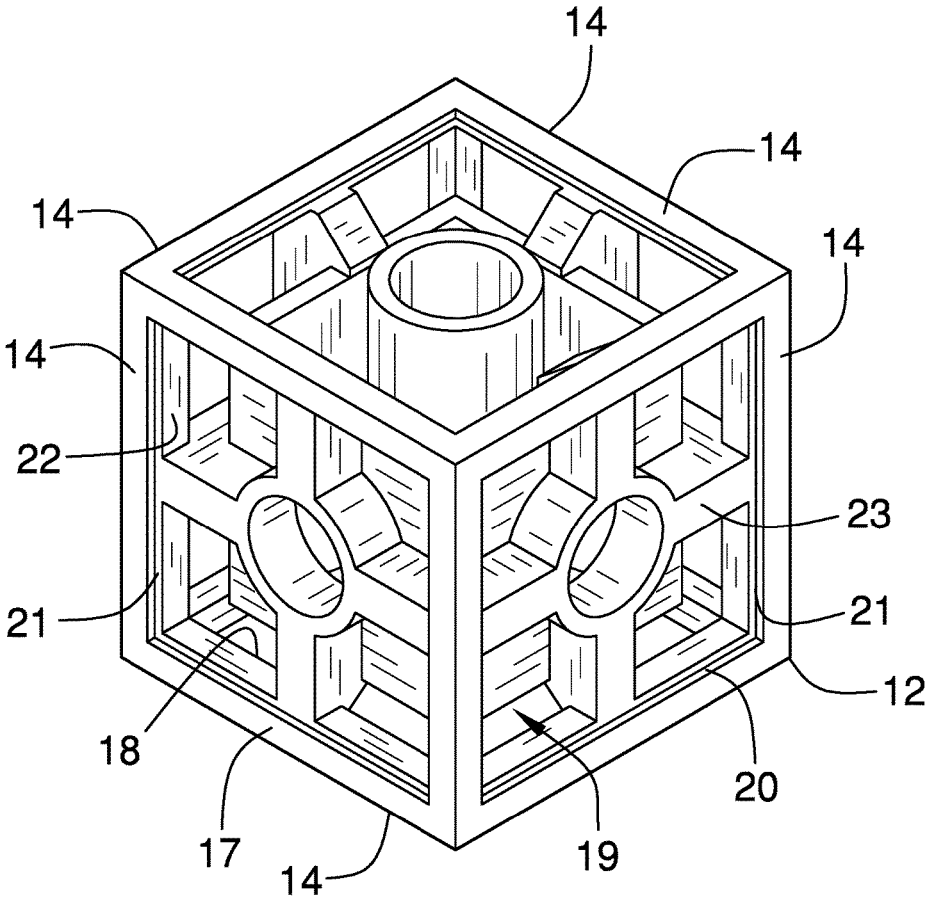
FIG. 1 is a top perspective view of an all-female brick of a toy building brick system according to an embodiment of the disclosure.
Figure 2:
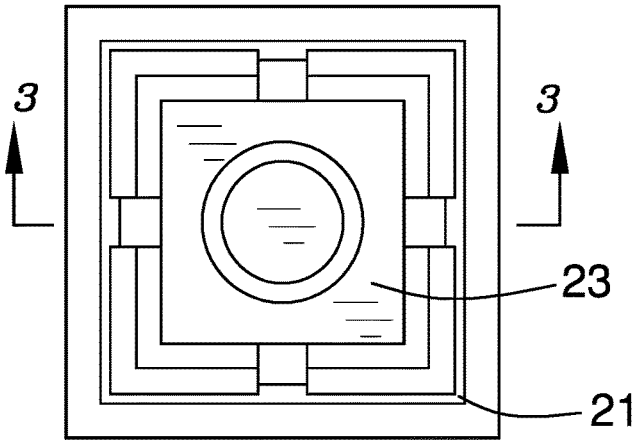
FIG. 2 is a bottom view of an embodiment of the disclosure.
Figure 3:
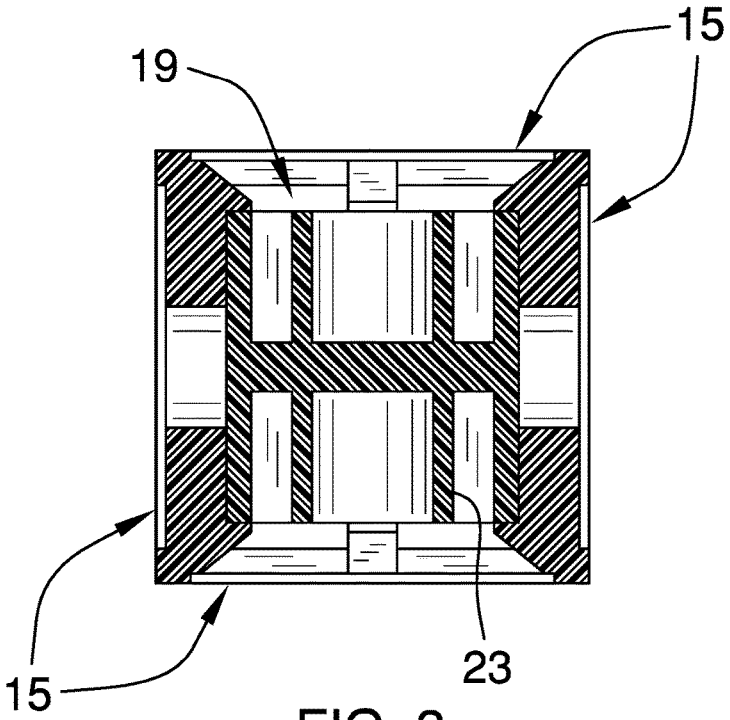
FIG. 3 is a cross-sectional view of an embodiment of the disclosure taken along line 3-3 of FIG. 2.
Figure 4:
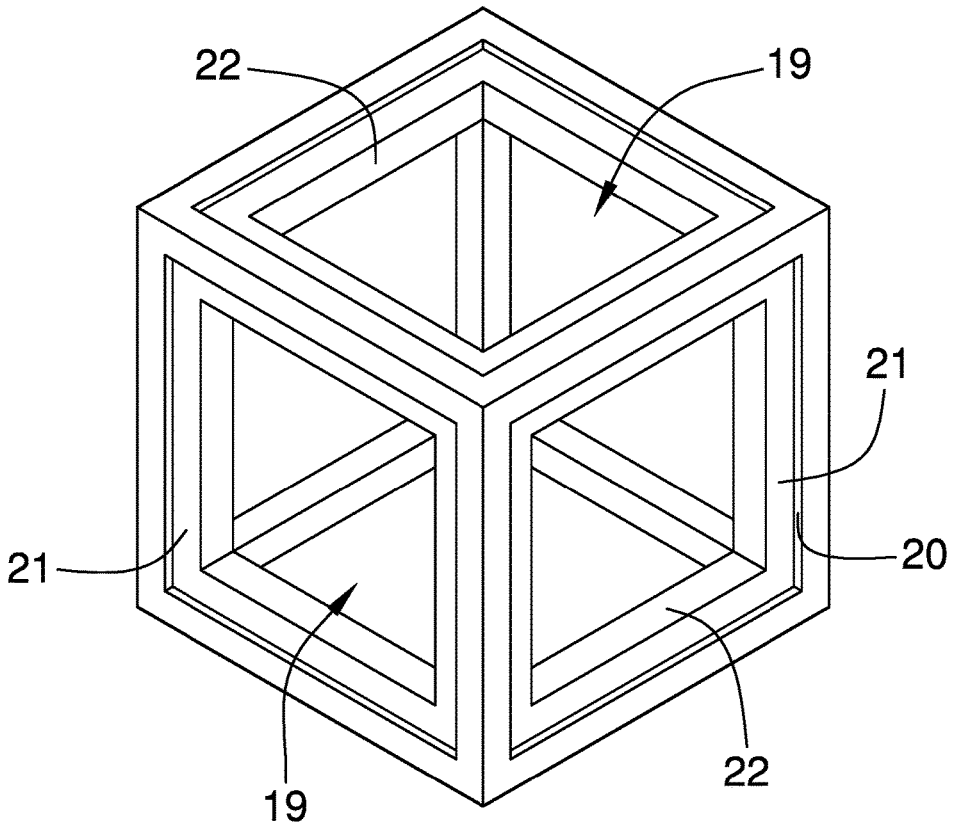
FIG. 4 is a perspective view of another embodiment of an all-female brick of the disclosure.

With reference now to the drawings, and in particular to FIGS. 1 through 30 thereof, a new toy building brick devices embodying the principles and concepts of an embodiment of the disclosure and generally designated by the reference numeral 10 will be described.

As best illustrated in FIGS. 1 through 30, the toy building brick system 10 generally comprises a structure and system to be utilized with building brick systems utilizing generally similar structures for frictionally coupling together these structures. Typically these structures comprise interconnecting toy bricks and the systems therefore. These brick systems are ubiquitous in the toy arts and are found in multiple references such as U.S. Pat. No. 3,005,282. Toy bricks of this type may be found, for instance, being sold under the names Lego and Duplo. Lego and Duplo bricks may be analogous to either generally, but vary in size with respect to each other. More particularly, the Duplo toy bricks includes larger features than Lego toy bricks which allows Duplo type bricks to be used more easily by small children.

The system 10 herein includes a base brick 12 having a cubic shape such that the base brick comprises six outer walls 14. The base brick 12 has an open interior and each of the outer walls 14 comprises a female receiver 15 such that six female receivers 15 are formed in the base brick 12. More specifically, each of the outer walls 14 includes a panel that has an outer surface 17 and an inner surface 18. The panel has an opening 19 therein extending through the outer 17 and inner 18 surfaces and is centrally located. Though other shapes may be utilized, such as particularly rectangular, more typically the opening 19 will be square shaped and is bounded by a perimeter surface 20. A shoulder 21 is formed in the perimeter surface 20 and extends inward of the opening 19. The shoulder 21 is co-extensive with the perimeter surface 20. The shoulder 21 is spaced from the outer surface 17 to form the female receiver 15 from the outer surface 17 to the shoulder 21. The shoulder 21 may further have an interior edge 22 bounding the opening 19. In particular version of the base brick, as found in FIG. 4, includes an interior being entirely open. Another embodiment, found in FIGS. 1-3, includes internal bracing 23 structure to provide rigidity to the base brick 12 as well as structural support to prevent the base brick 12 from bending or cracking along its outer edges.

A plurality of inserts 26 is provided and each of the inserts 26 is removably engaged with one of the female receivers 15 such that an outer surface 27 of each of the inserts 26 faces outwardly of the open interior of the base brick 12. As shown generally in FIGS. 5-8 and FIGS. 13-14, the inserts 26 each include a plate 28 that has a first side 29, a second side 30 and a perimeter edge 31 wherein the first side 29 defines the outer surface 27. The perimeter edge 31 is abuttable against and frictionally engaged to the perimeter surface 20 of the female receiver 15. More particularly, the plate 28 will have the same shape as the female receiver 15 and therefore will typically have a square shape. The second side 30 is abuttable against the shoulder 21.

Figure 5:
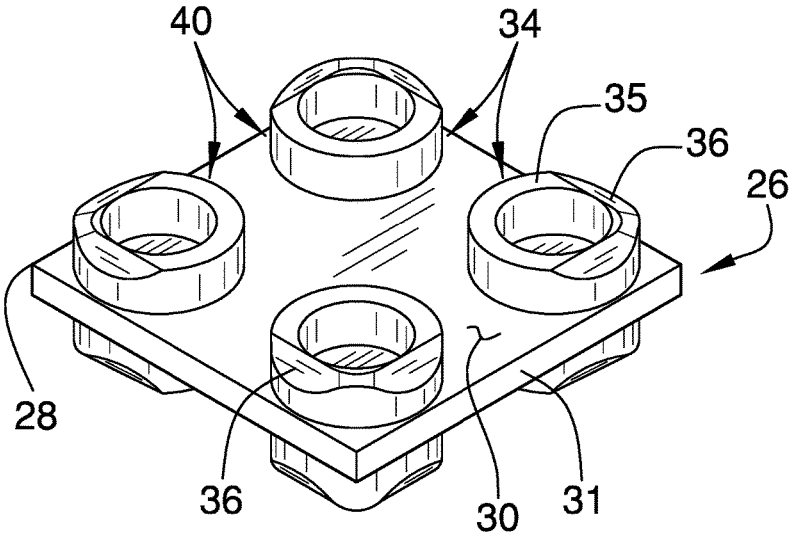
FIG. 5 is a top perspective view of an embodiment of an insert of the disclosure.
Figure 6:
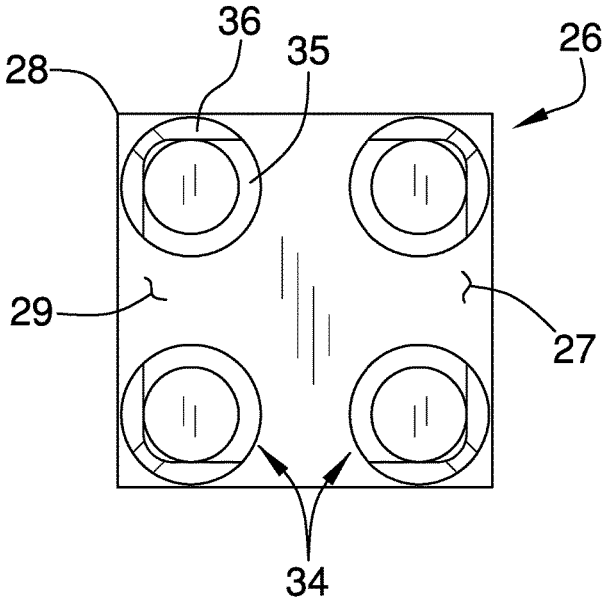
FIG. 6 is a bottom view of an embodiment of FIG. 5 of the disclosure.
Figure 21:
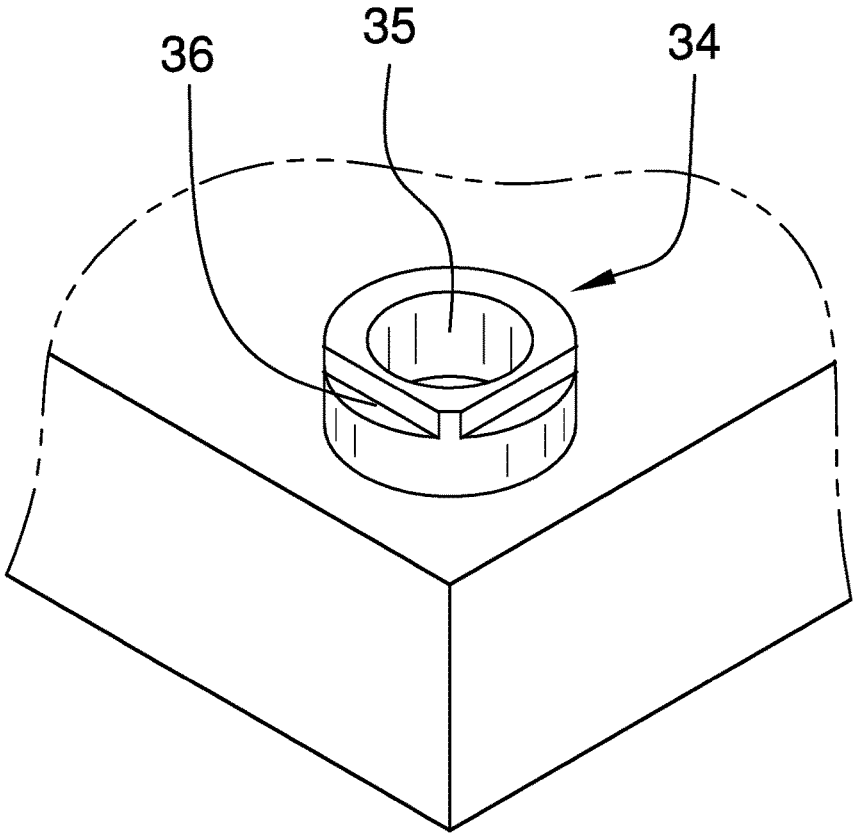
FIG. 21 is a perspective view of a male peg of an embodiment of the disclosure.
Figure 22:
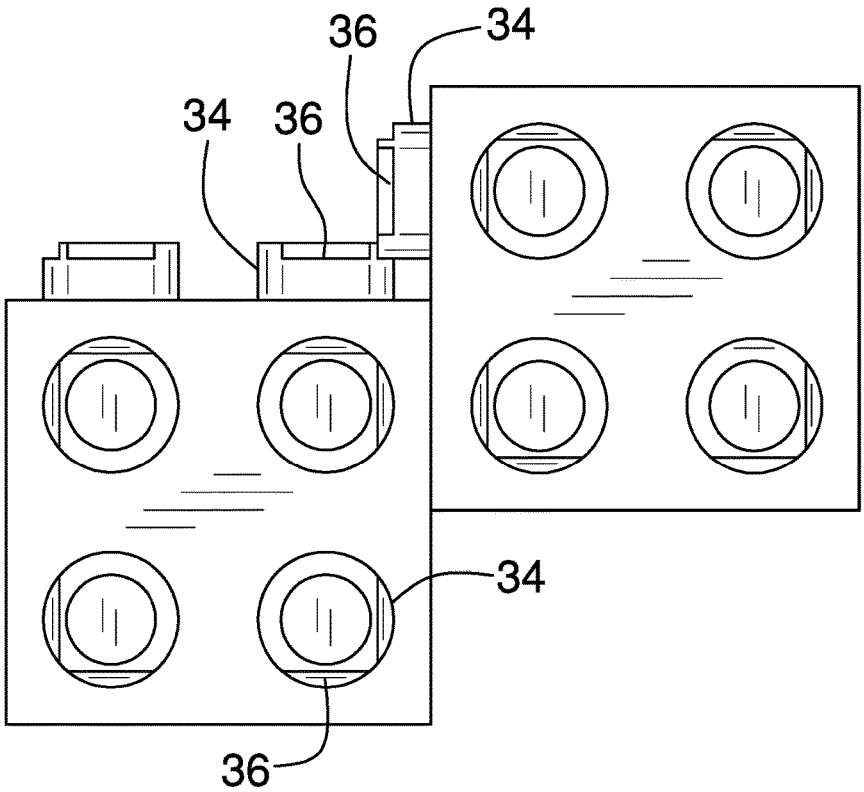
FIG. 22 is a side view of an embodiment of the disclosure.
Figure 28:
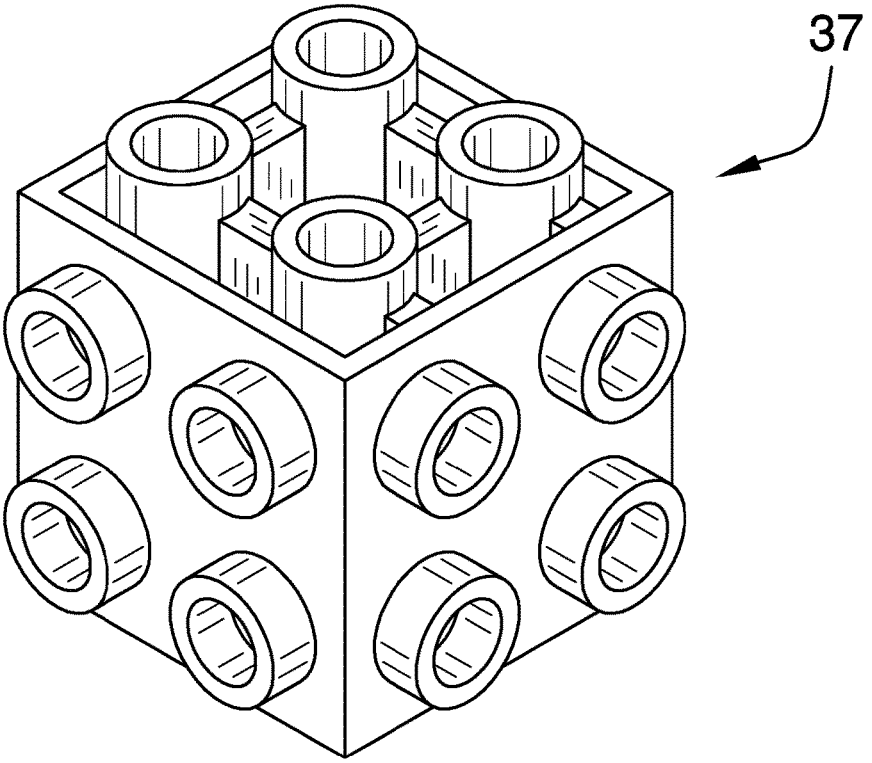
FIG. 28 is a top and front perspective view of an all-male sided brick of the disclosure wherein a bottom and rear perspective view thereof is a mirror image of FIG. 28.

A plurality of male pegs 34 may be attached to the second side 30 as shown in FIG. 5. The male pegs 34 frictionally engaging the interior edge 22 of the shoulder 21 and/or the internal bracing 23 found in FIG. 1. Each of the male pegs 34 has a terminal end 35. As can be seen in FIG. 5, the terminal ends 35 may each have notches 36 therein such that the terminal ends 35 are angled downwardly toward adjacent portions of the perimeter edge. Alternatively a ledge may be formed by the notches 36 as shown in FIGS. 21 and 22. The notches allow for adjacent interaction of male pegs 34 of stacked of adjacent blocks as shown in FIG. 22. The notches 36 may also be utilized to allow a tighter, flusher fit with the perimeter surfaces of the female receivers 15. While not all male pegs 34 of the Figures include notches 36, it should be understood that all or none of the male pegs discussed herein and shown in the Figures may include the notches. This may be particularly true for FIG. 28 depicting an all-male brick 37 having all six sides being male, as opposed to female, couplers. While these male pegs 34 are shown as cylinders, they may also include notches 36.

Figure 25:
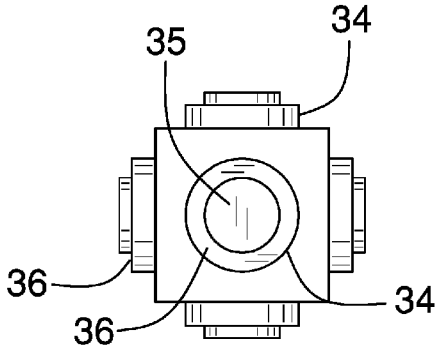
FIG. 25 is a top view of a single peg brick an embodiment of the disclosure.
Figure 26:
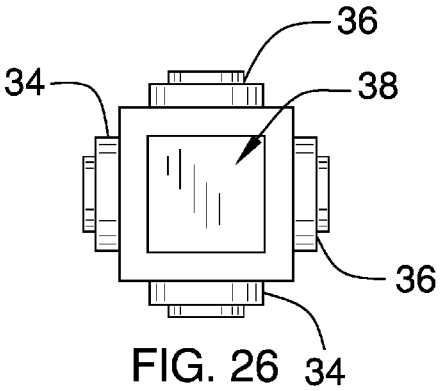
FIG. 26 is a bottom view of FIG. 25 of the disclosure.
Figure 27:
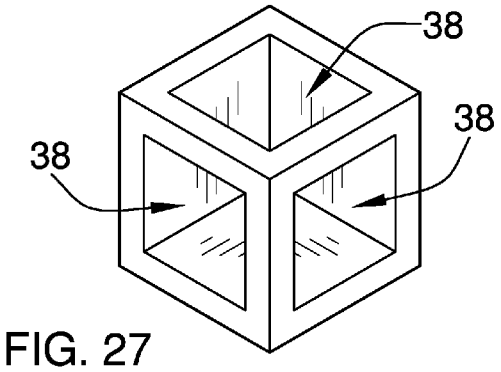
FIG. 27 is a perspective view of a single peg brick of an embodiment of the disclosure.

FIGS. 25-27 include male peg 34 and female receiver combination bricks. The notches 36 in these male pegs 34 may extend completely around each terminal end 35 since with a single male peg 34 its entire perimeter is adjacent to portions of the perimeter edges of the brick to which it is attached. FIG. 25 shows a version of a single pegged sides from the top and FIG. 26 is shows the bottom having a female connector 38. Thus, FIGS. 25 and 26 include five male pegged sides and one female connector side. FIG. 27 includes three female connectors 38 and the opposite sides include three male pegs 34 which are not viewable from the depicted view. Also contemplated, but not shown, is an embodiment including two adjacent female connectors 38 and an embodiment including two oppositely positioned female connectors 38.

Figure 13:
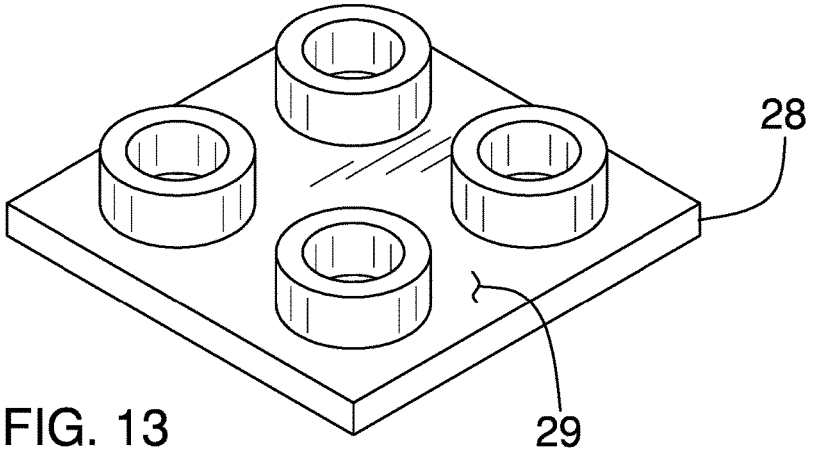
FIG. 13 is a bottom perspective view of an embodiment of an insert of the disclosure.
Figure 14:
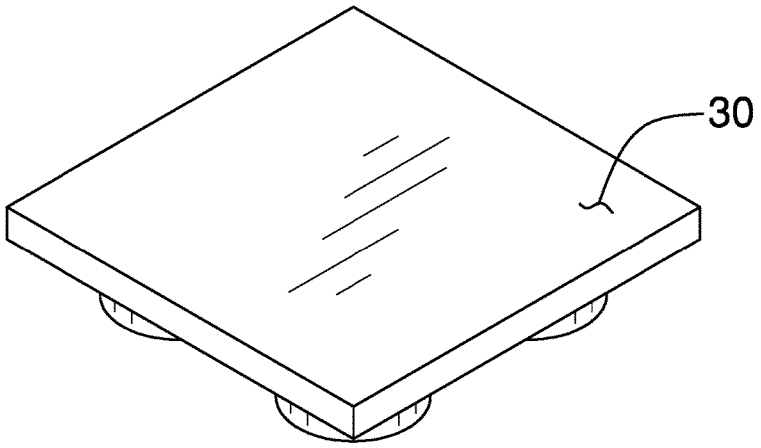
FIG. 14 is a top perspective view of an embodiment of an insert of FIG. 13 of the disclosure.
Figure 15:
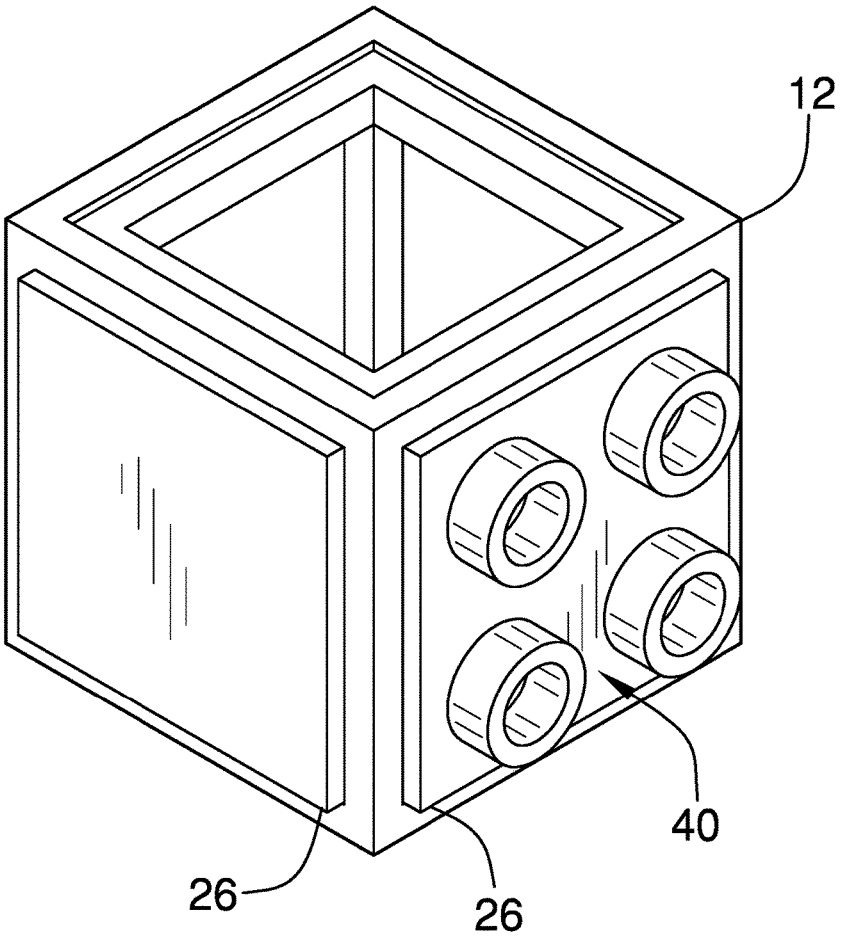
FIG. 15 is a front perspective view of an embodiment of the disclosure.
Figure 16:
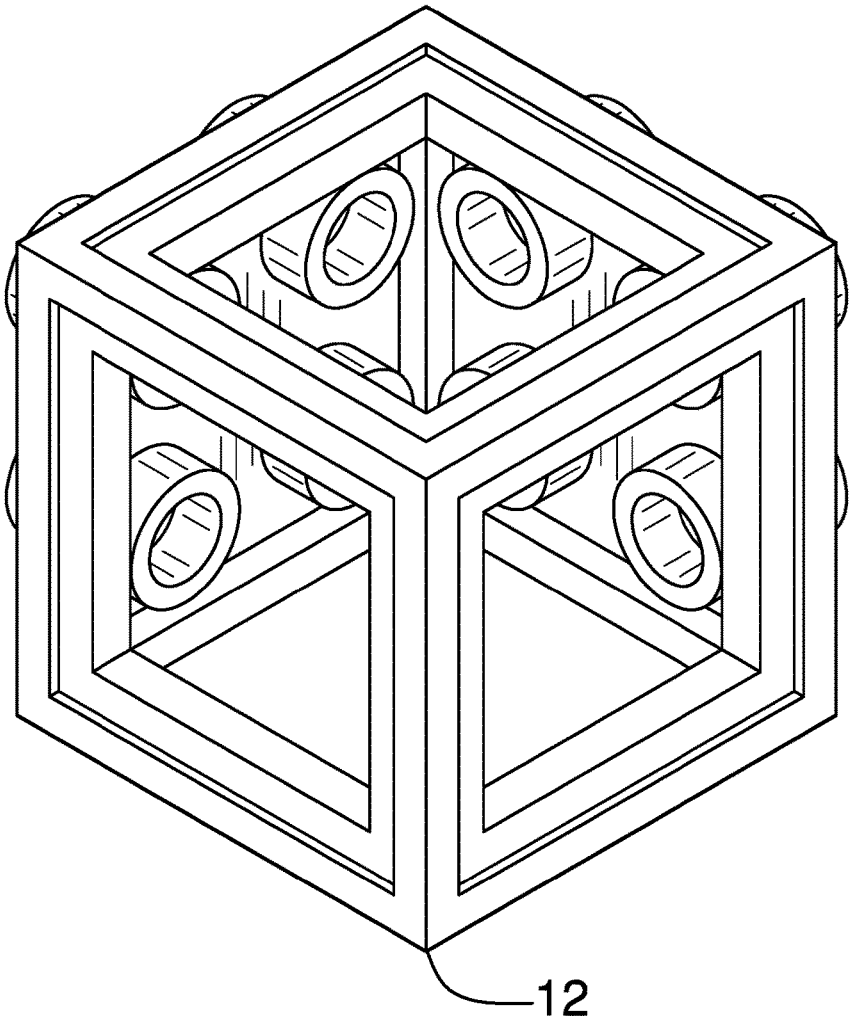
FIG. 16 is a rear perspective view of FIG. 15 of an embodiment of the disclosure.
Figure 17:
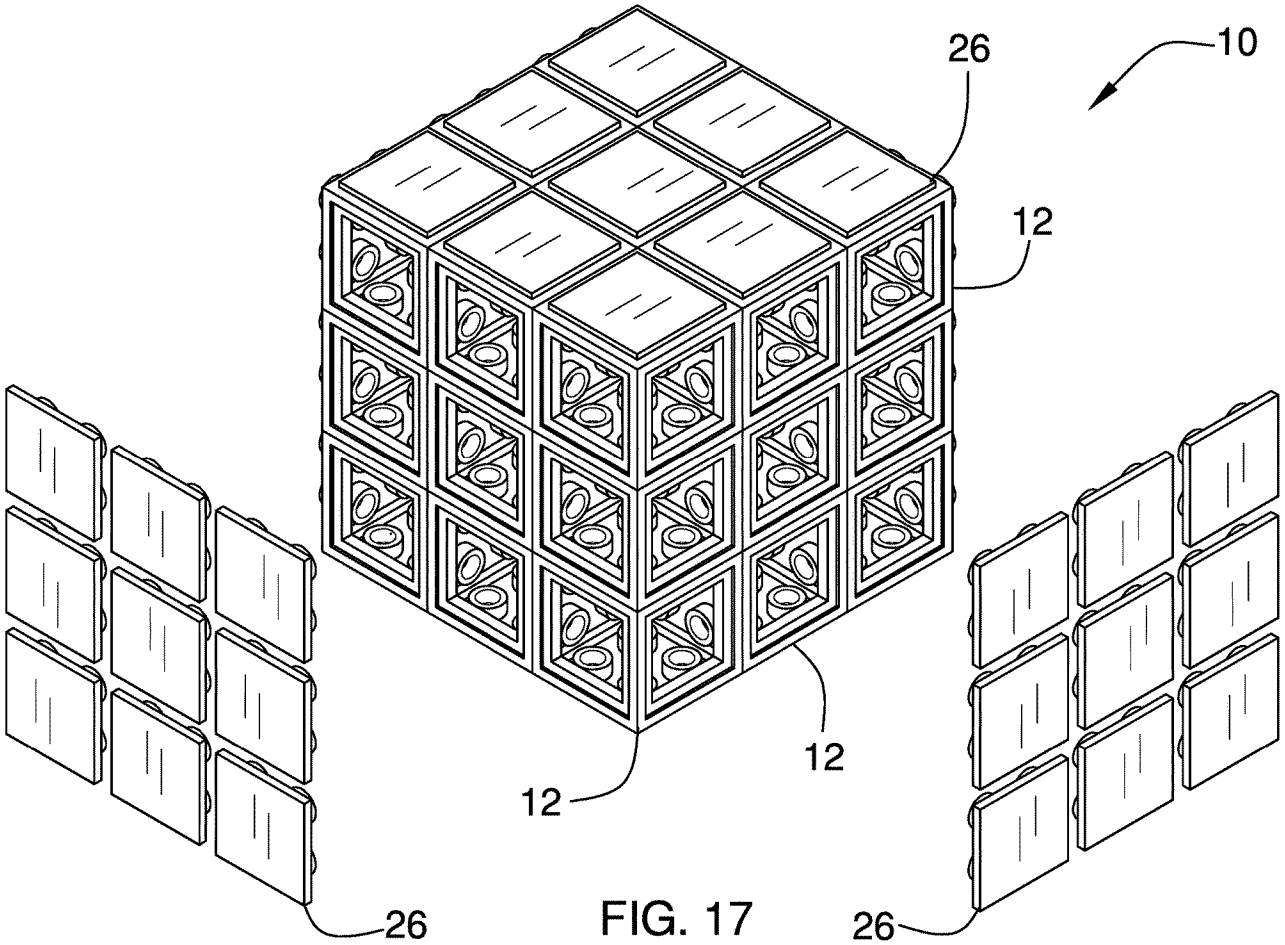
FIG. 17 is a partially exploded perspective view of an embodiment of the disclosure.

A plurality of male connectors 40 may be provided and attached to outer surfaces, or second sides 30, of the plurality of inserts 26 as shown in FIG. 5. However, as shown in FIG. 13, the outer surfaces 30 may be planar. The outer surface 30 of the plurality of inserts 26 having the male connectors 40, as shown in FIG. 5, will include at least one male connector 40 attached thereto and each of the male connectors 40 may comprise a plurality of male pegs 34. More specifically, each male connector 40 may include four male pegs 34. Thus, some of the inserts 26 will be reversible and some will not and furthermore some inserts 26 will include means for engaging other bricks opposite of the base brick to which they are first attached. This is best shown in FIGS. 15 and 16 wherein both types of inserts 26 are being utilized with a single base brick 12. FIG. 17 shows how inserts 26 having planar outer surfaces 30 may be positioned such that they encapsulate a plurality of base bricks 12 having inserts including male connectors 40 so that adjacent ones of the base bricks 12 may be coupled together.

Figure 18:
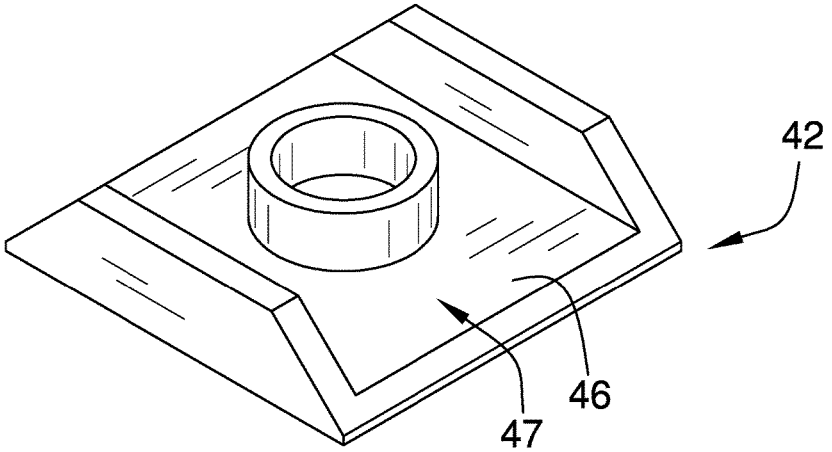
FIG. 18 is a bottom perspective view of a cover of an embodiment of the disclosure.
Figure 19:
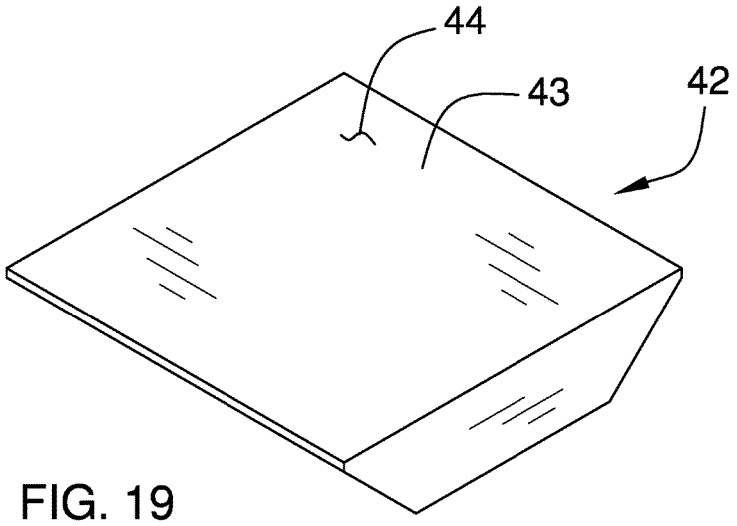
FIG. 19 is a top perspective view of an embodiment of FIG. 18 of the disclosure.
Figure 23:
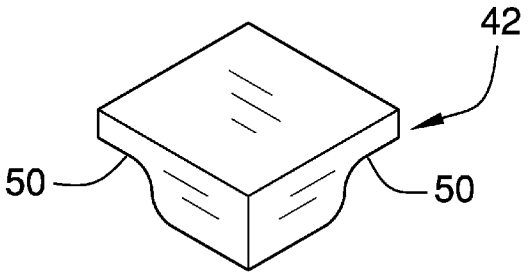
FIG. 23 is a top perspective view of a cover of an embodiment of the disclosure.
Figure 24:
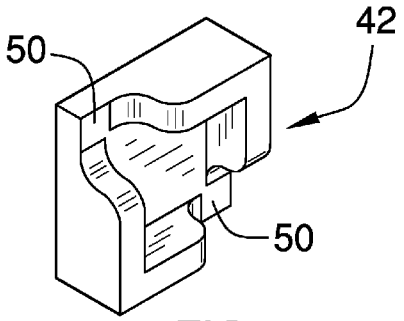
FIG. 24 is a bottom perspective view of FIG. 23 of the disclosure.
Figure 29:
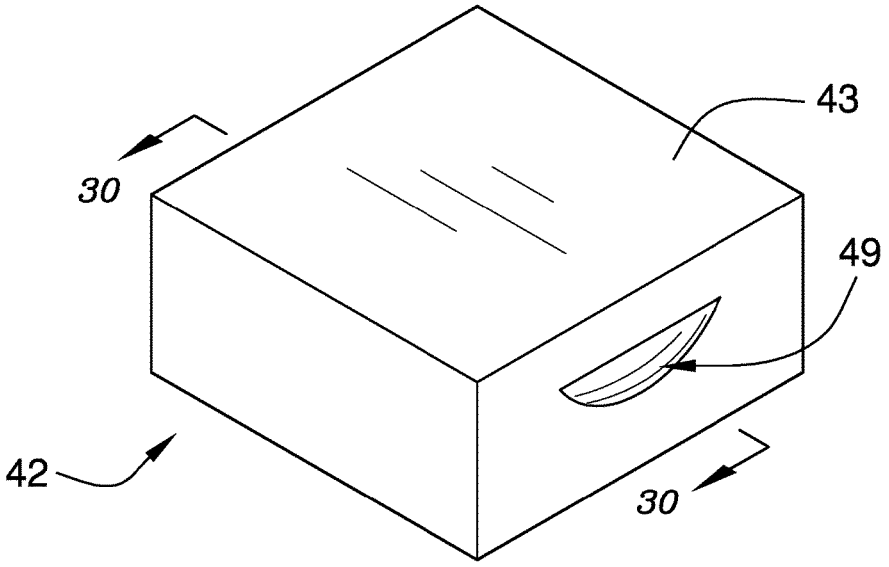
FIG. 29 is a top perspective view of an embodiment of a cover of the disclosure.
Figure 30:
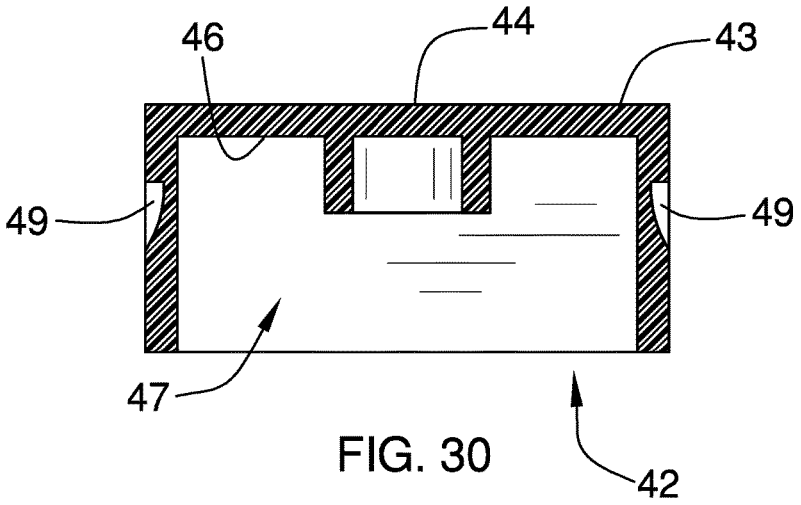
FIG. 30 is a cross-sectional view taken along line 30-30 of FIG. 29.

The system 10 includes a plurality of covers 42, examples of which are found in FIGS. 18, 19, 23, 24, 29 and 30. Each of the covers 42 is removably attached to one of the male connectors 40. The covers 42 are positionable over and cover an associated one of the outer surfaces 30. Each of the covers 42 includes a rectangular member 43 having a first side 44 and a second side 46. The rectangular member 43 comprises a solid wall and the second sides 46 of the covers 42 each including a female connector 47 engageable with one of the male connectors 40. The female connector 47 includes a receiving space for receiving and frictionally engaging the male pegs 34 of the male connectors 40. FIGS. 18 and 19 include trapezoidal side walls and open sided ends for allowing a person to more easily grip the covers 42 to disengage them from the male connectors. FIG. 23 and FIG. 24 depict additional embodiments of the covers 42 having corner openings 50 therein. The embodiment in FIGS. 29 and 30 provide for a peripheral wall 48 having cutout 49 formed therein for gripping by a person's fingernail. The open sided ends, corner openings 50 and cutouts 49 all provide a gripping area to facilitate disengagement of the coves 42 from the male connectors 40/male pegs 34. It should be understood that each cover 42 may be sized to engage any selected amount of male pegs 34. The embodiment in FIG. 24 may best be suited for engagement with single male peg while that found in FIG. 18 might include any required size so that it would fit matrixes of 2×2 male pegs, 3×3 male pegs and the like. The first sides 44 of the covers 42 are completely planar meaning that they are without any structure extending upwardly therefrom.

Figure 9:
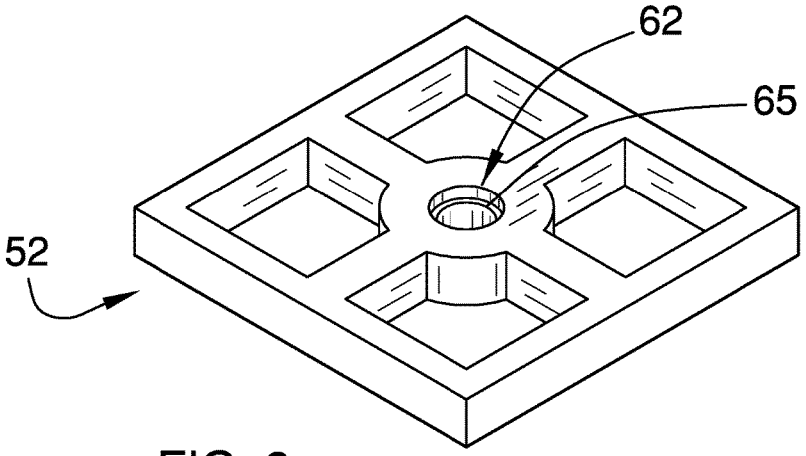
FIG. 9 is a top perspective view of an embodiment of the disclosure of an extension member including a rotational coupler connection.
Figure 10:
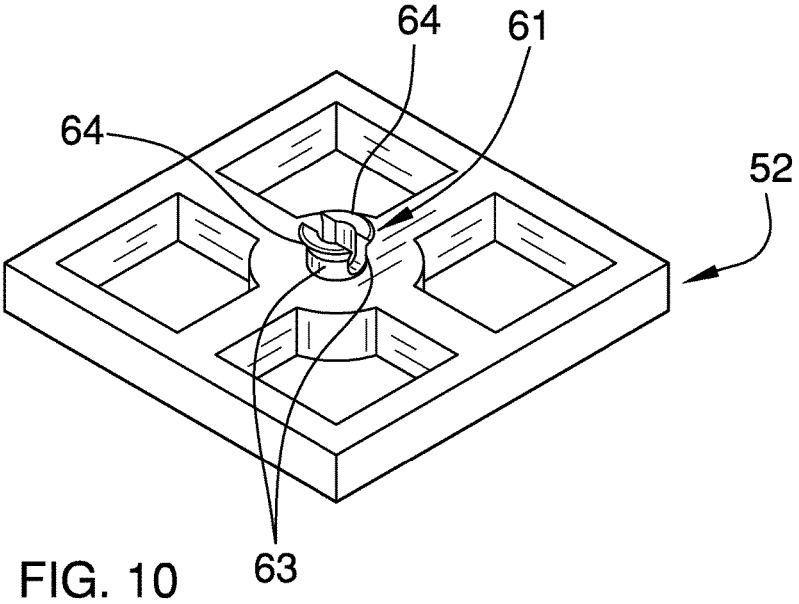
FIG. 10 is a top perspective view of an embodiment of the disclosure of an extension member including a rotational coupler connection.
Figure 11:
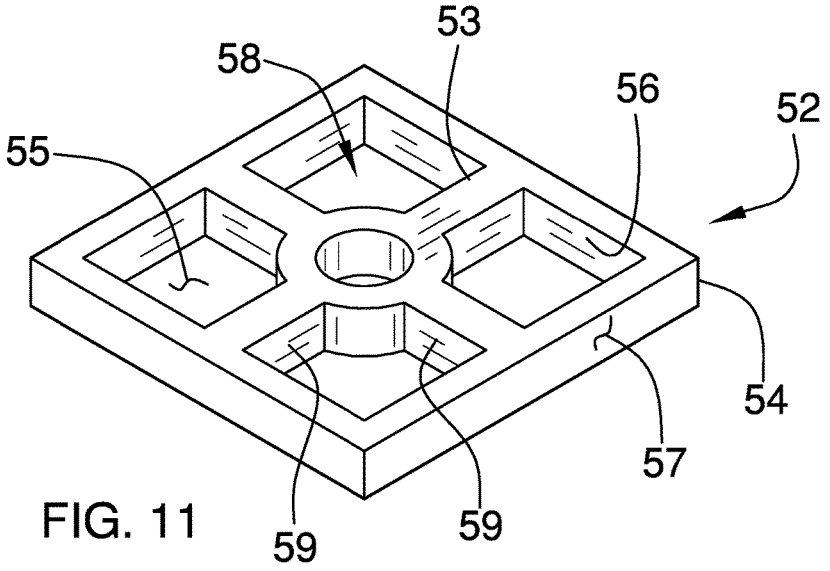
FIG. 11 is a top perspective view of an embodiment of an extension member of the disclosure.

FIGS. 9-12 depict various extenders 52 that are connectable with the inserts 26 to allow two inserts 26 to be coupled together. Each of the extenders 52 includes a frame 53 having an outer perimeter wall 54 bounding an inner space 55. The outer perimeter wall 54 has an interior surface 56 and an exterior surface 57. The interior surface 56 extends around an aperture 58 passing through the extender 52. Each of the male connectors 40 is removably receivable and engageable with one of the interior surfaces 56. The aperture 58 may be square shaped or substantially square shaped as is shown in FIG. 11. A pair of supports 59 traverses the aperture 58 and is attached to the interior surface 56. The supports 59 are orientated perpendicular to each other. As can be seen in FIGS. 9-12, the supports 59 divide the aperture 58 into four sub-openings 60 each positioned to receive a single male peg 34. In this manner, the extenders 52 allow two inserts 26 to be attached together. When multiple base bricks 12, inserts 26 and extenders 52 are used in conjunction with each other, the system 10 may be used to form various structures such as a cube. The extenders 52, particularly those of the type shown in FIG. 11, will typically have apertures having a depth equal to at least two times a height of the male pegs 34 but less than 2.5 times the height of the male pegs 34. The extenders 52 may also be used with all-male bricks 37 of the type found in FIG. 28 to allow two male bricks to be coupled together in close proximity to each other to simulate a cube shape as is being formed in FIG. 20. However, it should be understood that the structure of FIG. 20 may be comprised of all-female base bricks 12 including inserts 26 having outwardly extending male couplers 40 that are engaged with the extenders 52.

Figure 7:
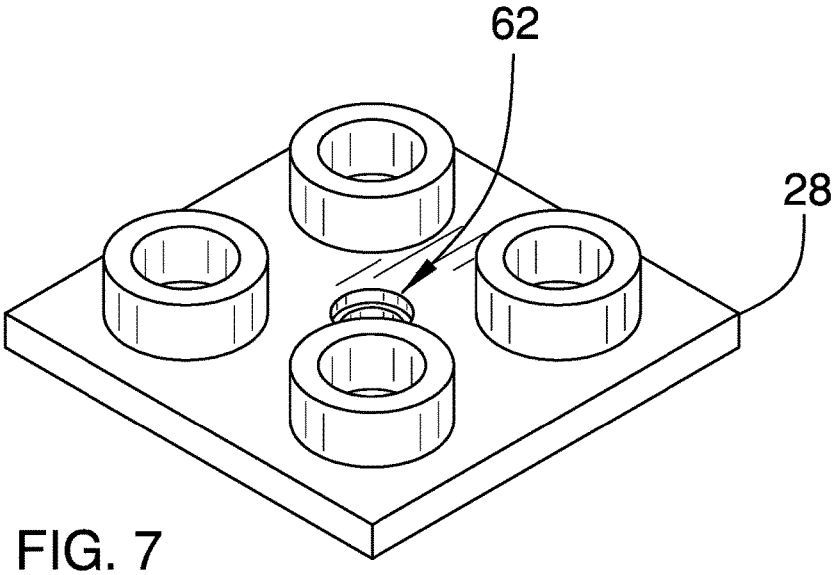
FIG. 7 is a top perspective view of an embodiment of the disclosure of an insert including a rotational coupler connection.
Figure 8:
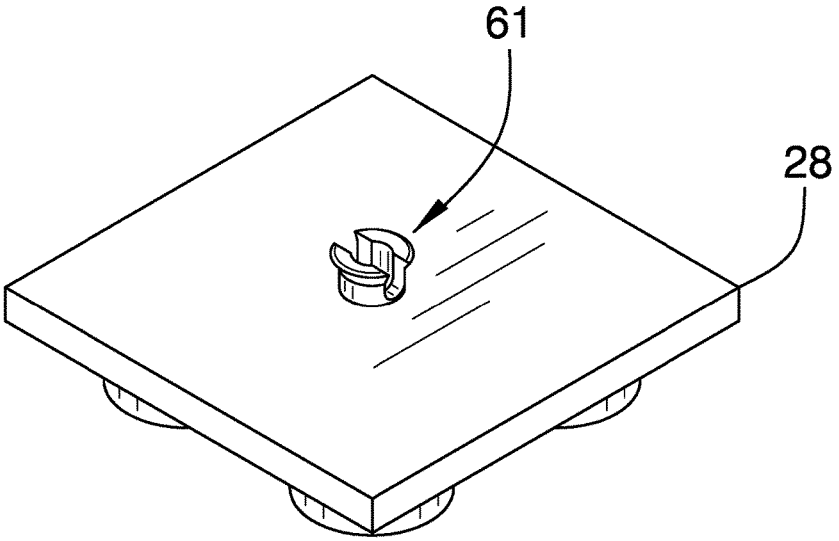
FIG. 8 is a top view of an embodiment of the disclosure of an insert including a rotational coupler connection.

While FIGS. 9 and 10 appear to have a similar depth as the extender of FIG. 11, these extenders 52 may only require a depth equal to at least the height of a male peg 34. These versions of the extenders 52 include rotational couplers. Each of rotational couplers includes a first mating member 61 and a second mating member 62. At least some of the extenders 52 has one of the first mating members 61 coupled thereto and at least some of the extenders 52 has one of the second mating members 62 coupled thereto. The first mating member 61 of one of the extenders 52 is removably engageable to the second mating member 62 of one of the extenders 52 to rotationally couple corresponding ones of the extenders 52 together. The corresponding ones of the extenders 52 has a rotational axis orientated and aligned with an axis of associated ones of the apertures 58. The first 61 and second 62 mating members may also be found on inserts 26 as shown in FIGS. 7 and 8. The rotational couplers allow pairs of the inserts 26 and/or pairs of extenders to be rotationally coupled together as well as inserts 26 rotationally coupled to extenders 52. The first mating member 61 may include a pair of arms 63 each having a free end including a flange 64. The arms 63 are extendable into the second mating member 62 and the flanges 64 insertable into an annular slot 65 positioned within the second mating member 62 to allow the flanges 64 to engage and rotate with respect to the second mating member 62.

Figure 12:
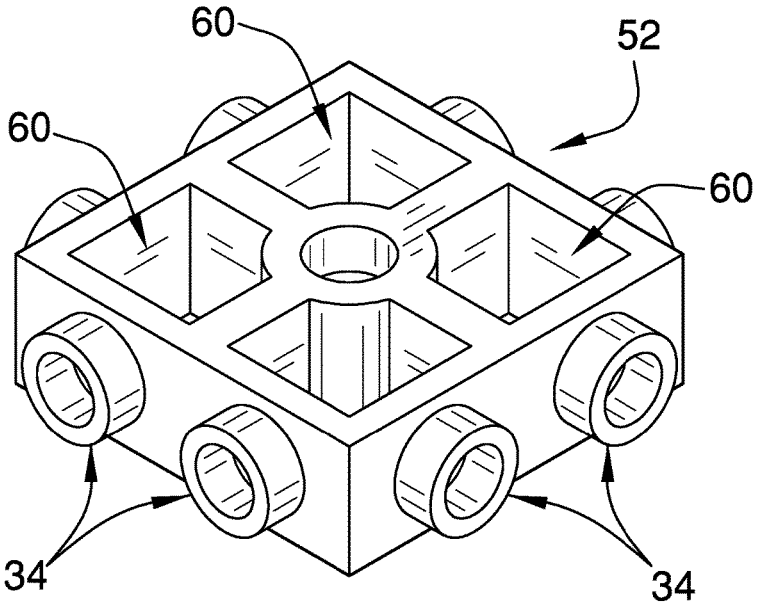
FIG. 12 is a top perspective view of an embodiment of an extension member of the disclosure.

FIG. 12 provides for an extender 52 having a peripheral edge including male pegs 34 for engagement with other bricks. The male pegs 34 shown in FIG. 12 include two male pegs 34 positioned on each independent side of the peripheral edge wherein the peripheral edge includes four independent sides. However, only two oppositely positioned ones of the independent sides may include male pegs 34.

Figure 20:
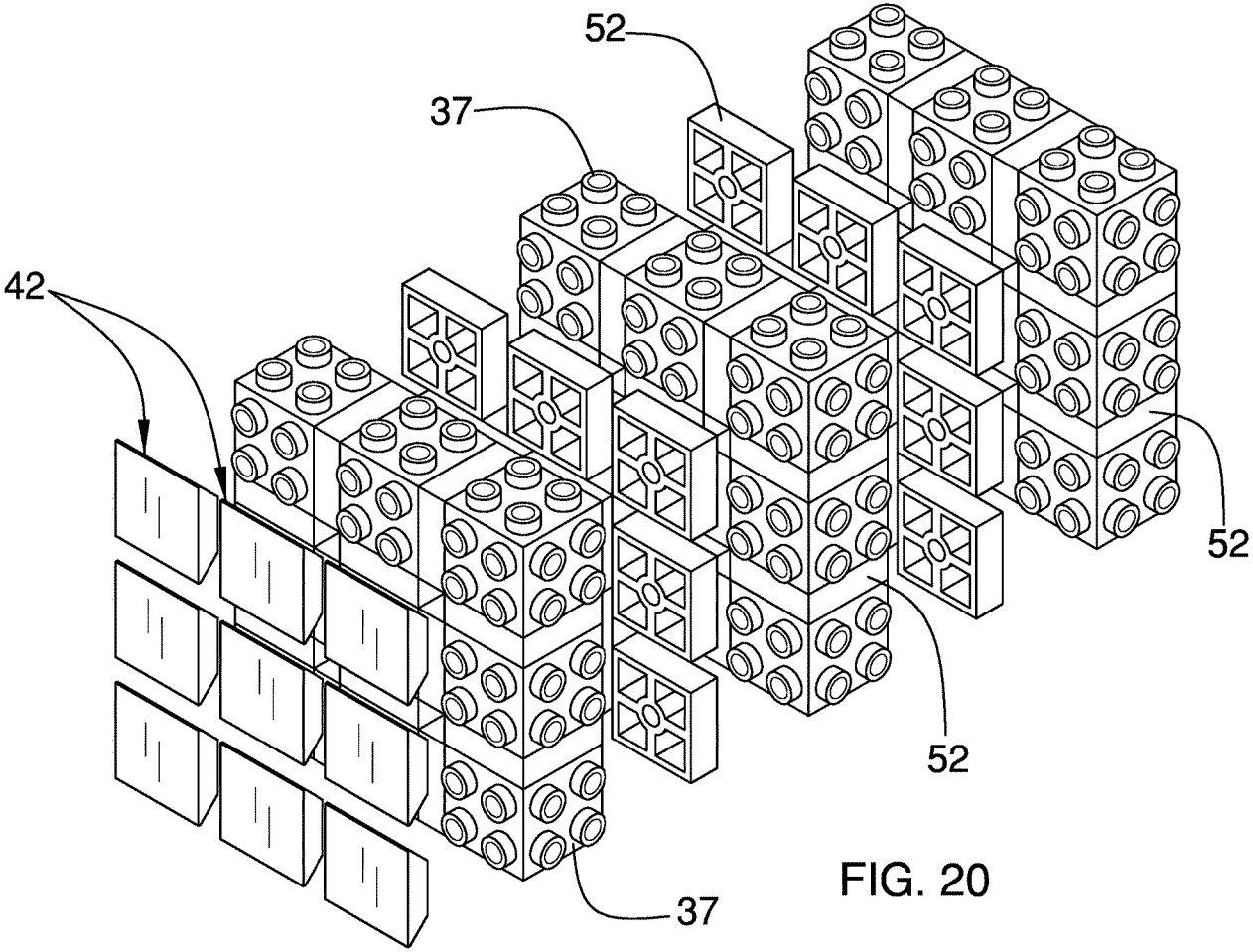
FIG. 20 is an exploded perspective view of an embodiment of the disclosure.

In use, the system 10 allows a person to utilize all-female building bricks, represented by the base bricks 12, to construct arrangements not previously allowed by way of conventional toy brick assemblies. The user may use the inserts 26 to simply cover the female receivers 15, attach covers 42 to the base bricks 12 or, by utilizing the extenders 52, to connect base bricks 12 together. As can be seen in FIGS. 17 and 20, this structure allows the user of the system 10 to build in all directions simultaneously and to build cubic structures not available with other toy brick assemblies. The covers 53 provide for pleasing aesthetics and may be colored multiple colors to allow personal tailoring of structures created with the system 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A building brick system comprising: a base brick having a cubic shape such that said base brick comprises six outer walls, said base brick having an open interior, each of said outer walls comprising a female receiver such that six female receivers are formed in said base brick; a plurality of inserts, each of said inserts being removably engaged with one of said female receivers such that an outer surface of each of said inserts faces outwardly of said open interior; a plurality of male connectors, each said outer surface of said plurality of inserts having one of said male connectors attached thereto; a plurality of extenders, each of said extenders being engageable with one of said male connectors of one insert and one of said male connectors of another of said inserts to couple two of said inserts together; and a plurality of rotational couplers, each of rotational couplers including a first mating member and a second mating member, at least some of said extenders having one of said first mating members coupled thereto, at least some of said extenders having one of said second mating members coupled thereto, said first mating member of one of said extenders being removably engageable to said second mating member of one of said extenders to rotationally couple corresponding ones of said extenders together.

2. The building brick system according to claim 1, wherein each of said outer walls includes a panel having an outer surface and an inner surface, said panel having an opening therein extending through said outer and inner surfaces and being centrally located, said opening being square shaped and being bounded by a perimeter surface.

3. The building brick system according to claim 2, wherein each of said outer walls further includes a shoulder being formed in said perimeter surface and extending inward of said opening, said shoulder being co-extensive with said perimeter surface, said shoulder being spaced from said outer surface to form said female receiver from said outer surface to said shoulder, said shoulder having an interior edge bounding said opening.

4. The building brick system according to claim 2, wherein each of said inserts includes a plate having a first side, a second side and a perimeter edge, said first side defining said outer surface, said perimeter edge being abuttable against and frictionally engaged to said perimeter surface, said plate having a square shape.

5. The building brick system according to claim 3, wherein each of said inserts includes:

a plate having a first side, a second side and a perimeter edge, said first side defining said outer surface, said perimeter edge being abuttable against and frictionally engaged to said perimeter surface, said plate having a square shape, said second side being abuttable against said shoulder; and a plurality of male pegs being attached to said second side, said male pegs frictionally engaging said interior edge of said shoulder.

6. The building brick system according to claim 1, wherein each of said male connectors comprises a plurality of male pegs.

7. The building brick system according to claim 1, further including a plurality of covers, each of said covers being removably attached to one of said male connectors, said covers being positionable over and covering an associated one of said outer surfaces.

8. The building brick system according to claim 7, wherein each of said covers includes a rectangular member having a first side and a second side, said rectangular member comprising a solid wall, said second sides of said covers each including a female connector engageable with one of said male connectors.

9. The building brick system according to claim 6, further including a plurality of covers, each of said covers being removably attached to one of said male connectors, said covers being positionable over and covering an associated one of said outer surfaces, each of said covers including a rectangular member having a first side and a second side, said rectangular member comprising a solid wall, said second sides of said covers each including a female connector engageable with one of said male connectors, said female connector including a receiving space for receiving and frictionally engaging said male pegs of said male connectors, each of said first sides of said covers being completely planar.

10. The building brick system according to claim 1, each of said extenders including a frame having an outer perimeter wall bounding an inner space, said outer perimeter wall having an interior surface and an exterior surface, said interior surface extending around an aperture passing through said extender, each of said male connectors being removably receivable and engageable with one of said interior surfaces.

11. A building brick system comprising:

a base brick having a cubic shape such that said base brick comprises six outer walls, said base brick having an open interior, each of said outer walls comprising a female receiver such that six female receivers are formed in said base brick, each of said outer walls including a panel having an outer surface and an inner surface, said panel having an opening therein extending through said outer and inner surfaces and being centrally located, said opening being square shaped and being bounded by a perimeter surface, each of said outer walls further including a shoulder being formed in said perimeter surface and extending inward of said opening, said shoulder being co-extensive with said perimeter surface, said shoulder being spaced from said outer surface to form said female receiver from said outer surface to said shoulder, said shoulder having an interior edge bounding said opening;

a plurality of inserts, each of said inserts being removably engaged with one of said female receivers such that an outer surface of each of said inserts faces outwardly of said open interior, each of said inserts including a plate having a first side, a second side and a perimeter edge, said first side defining said outer surface, said perimeter edge being abuttable against and frictionally engaged to said perimeter surface, said plate having a square shape, said second side being abuttable against said shoulder, and a plurality of male pegs being attached to said second side, said male pegs frictionally engaging said interior edge of said shoulder; and wherein each of said male pegs has a terminal end, said terminal ends each having notches therein such that said terminal ends are angled downwardly toward adjacent portions of said perimeter edge.

12. A building brick system comprising:

a base brick having a cubic shape such that said base brick comprises six outer walls, said base brick having an open interior, each of said outer walls comprising a female receiver such that six female receivers are formed in said base brick, each of said outer walls including:

a panel having an outer surface and an inner surface, said panel having an opening therein extending through said outer and inner surfaces and being centrally located, said opening being square shaped and being bounded by a perimeter surface;

a shoulder being formed in said perimeter surface and extending inward of said opening, said shoulder being co-extensive with said perimeter surface, said shoulder being spaced from said outer surface to form said female receiver from said outer surface to said shoulder, said shoulder having an interior edge bounding said opening;

a plurality of inserts, each of said inserts being removably engaged with one of said female receivers such that an outer surface of each of said inserts faces outwardly of said open interior, each of said inserts including:

a plate having a first side, a second side and a perimeter edge, said first side defining said outer surface, said perimeter edge being abuttable against and frictionally engaged to said perimeter surface, said plate having a square shape, said second side being abuttable against said shoulder;

a plurality of male pegs being attached to said second side, said male pegs frictionally engaging said interior edge of said shoulder, each of said male pegs having a terminal end, said terminal ends each having notches therein such that said terminal ends are angled downwardly toward adjacent portions of said perimeter edge;

a plurality of male connectors, each said outer surface of said plurality of inserts having one of said male connectors attached thereto, each of said male connectors comprising a plurality of male pegs;

a plurality of covers, each of said covers being removably attached to one of said male connectors, said covers being positionable over and covering an associated one of said outer surfaces, each of said covers including a rectangular member having a first side and a second side, said rectangular member comprising a solid wall, said second sides of said covers each including a female connector engageable with one of said male connectors, said female connector including a receiving space for receiving and frictionally engaging said male pegs of said male connectors, said first sides of each of said covers being completely planar;

a plurality of extenders, each of said extenders being engageable with one of said male connectors of one insert and one of said male connectors of another of said inserts to couple two of said inserts together, each of said extenders including;

a frame having an outer perimeter wall bounding an inner space, said outer perimeter wall having an interior surface and an exterior surface, said interior surface extending around an aperture passing through said extender, each of said male connectors being removably receivable and engageable with one of said interior surfaces, said aperture having a square shape;

a pair of supports traversing said aperture and being attached to said interior surface, said supports being orientated perpendicular to each other;

a plurality of rotational couplers, each of rotational couplers including a first mating member and a second mating member, at least some of said extenders having one of said first mating members coupled thereto, at least some of said extenders having one of said second mating members coupled thereto, said first mating member of one of said extenders being removably engageable to said second mating member of one of said extenders to rotationally couple corresponding ones of said extenders together, said corresponding ones of said extenders having a rotational axis orientated and aligned with an axis of associated ones of said apertures.

* * * * *